US005404612A

United States Patent [19]

Ishikawa

[11] Patent Number: 5,404,612

[45] Date of Patent: Apr. 11, 1995

[54] VACUUM CLEANER

[75] Inventor: Masahiro Ishikawa, Osaka, Japan

[73] Assignee: Yashima Electric Co., Ltd., Japan

[21] Appl. No.: 107,583

[22] Filed: Aug. 18, 1993

[51] Int. Cl.[6] ..... A47L 9/19

[52] U.S. Cl. ..... 15/319; 15/339

[58] Field of Search ..... 15/319, 339, 387

[56] References Cited

U.S. PATENT DOCUMENTS

| | | | |
|---|---|---|---|
| 4,601,082 | 7/1986 | Kurz | 15/319 |
| 5,033,151 | 7/1991 | Kraft | 15/319 |
| 5,144,715 | 9/1992 | Matsuyo | 15/319 |
| 5,163,202 | 11/1992 | Kawakami | 15/319 |
| 5,182,833 | 2/1993 | Yamaguchi | 15/319 |
| 5,233,682 | 8/1993 | Abe | 15/319 |

FOREIGN PATENT DOCUMENTS

| | | | |
|---|---|---|---|
| 0371632 | 6/1990 | European Pat. Off. . | |
| 0373353 | 6/1990 | European Pat. Off. . | |
| 0732903 | 6/1990 | European Pat. Off. . | |
| 4-193244 | 7/1992 | Japan | 15/339 |
| 2082351 | 3/1982 | United Kingdom . | |

OTHER PUBLICATIONS

Japanese Patent Abstract for Japanese Laid-Open Patent Application No. JP-A-3237955, published Oct. 23, 1991, entitled "Vacuum Cleaner" by Imia Hidetoski et al, Abstract vol. 016025 dated Jan. 22, 1992.

*Primary Examiner*—David A. Scherbel
*Assistant Examiner*—Terrence R. Till
*Attorney, Agent, or Firm*—Beveridge, DeGrandi, Weilacher & Young

[57] ABSTRACT

A vacuum cleaner rotates a propeller fan by its suction force. The propeller fan rotates a rotor of a d.c. electric energy generator so as to generate electrical energy, and a d.c. voltage corresponding to the suction force is obtained by the generation. The vacuum cleaner employs the d.c. voltage as an operating voltage for a dust sensor and the peripheral circuitry thereof. The vacuum cleaner compares the d.c. voltage with a constant voltage output from a constant-voltage circuit by a comparing circuitry. The vacuum cleaner lowers the gain of an amplifying circuitry based upon a signal output from the comparing circuitry in correspondance to an increasing of the d.c. voltage obtained by the d.c. electric energy generator. The amplifying circuitry amplifies output of the dust sensor. The vacuum cleaner automatically determines detection sensitivity to be a proper sensitivity. The detection sensitivity is the sensitivity for detecting dust, based upon an output from the dust sensor.

6 Claims, 6 Drawing Sheets

VACUUM CLEANER

BACKGROUND OF THE INVENTION

The present invention relates to a vacuum cleaner, more particularly, to a vacuum cleaner which can vary its suction force and which has a dust sensor for detecting the quantity of dust sucked.

Conventionally, a vacuum cleaner is required to perform complex functions as is required of other electritrical products. To satisfy the demand, it is proposed to provide a dust sensor to a vacuum cleaner. Specifically, a dust sensor for detecting the quantity of dust sucked is provided to a vacuum cleaner, and a detection signal from the dust sensor which corresponds to the quantity of dust sucked is displayed. When cleaning is carried out using the vacuum cleaner having the dust sensor, the degree of cleaning can be judged based upon the displayed quantity of dust sucked. Also, it is possible to judge whether or not dust to be sucked is present based upon the displayed quantity of dust sucked.

Vacuum cleaners having a dust sensor are classified into two groups. One group corresponds to vacuum cleaners which have their dust detection sensitivity set to a single predetermined sensitivity. The other group corresponds to vacuum cleaners which select dust detection sensitivities by operating a selection switch. Vacuum cleaners which belong to one of both groups are arranged to vary their suction forces.

When cleaning is carried out using a vacuum cleaner which has its dust detection sensitivity set to a single predetermined sensitivity, the cleaning usually is carried out under a strong suction force for cleaning of a carpet or the like which have long wool hair. When dust on the carpet has been completely sucked, that is when the cleaning is finished, the dust sensor may detect the pulled wool hair of the carpet. A disadvantage arises in that the vacuum cleaner cannot display the condition, in displaying the quantity of dust sucked, in which there is no sucking of dust (in other words, it displays the condition that cleaning is not finished) based upon the detection of pulled wool hair. On the contrary, when cleaning is carried out using a vacuum cleaner which has plural dust detection sensitivities and which selects one of the dust detection sensitivities by operating a selection switch, the dust detection sensitivity can be lowered by operating the selection switch for cleaning a carpet and the like under strong suction force. Pulled wool hair of the carpet is reliably prevented from being detected by the dust sensor. However, a disadvantage of this type of vacuum cleaner arises in that usage of the vacuum cleaner is complicated such that an operator must operate the selection switch so as to set a dust detection sensitivity of the dust sensor to a proper sensitivity which matches an object to be cleaned such as a wooden floor, a tatami mat, a carpet and the like. A further disadvantage arises in that no dust sucking is displayed when dust remains, or dust sucking is displayed when no dust remains, when operation of the selection switch has been forgotten for selection of the proper dust detection sensitivity. That is caused by complexity in the usage, because cleaning is carried out under an improper dust detection sensitivity for the object of cleaning.

Further, conventional dust sensors employ, as an operating voltage thereof, a voltage which is obtained by lowering the commercial power voltage to a predetermined voltage, or from a terminal voltage of a dry battery.

When the former voltage is employed as the operating voltage, disadvantages arise in that the arrangement of the vacuum cleaner becomes complicated and the vacuum cleaner becomes expensive. The reasons are that when a display device and the like for displaying a dust detection result is to be provided at a floor nozzle section for sucking dust, or at an operation section disposed at an interconnection portion of a bellows hose and an extending hose, at least two power supplying wires should be provided to the bellows hose in one body, in an entrained condition, and an electrical interconnection mechanism corresponding to the power supplying wires is needed at an interconnection portion of the bellows hose to the vacuum cleaner body. The bellows hose communicates by one of its ends to the vacuum cleaner body, and the extending hose communicates by both of its ends with the bellows hose and the floor nozzle section, respectively. A further disadvantage arises in that imperfect contact may occur in the electrical interconnection mechanism causing a claim for the imperfect contact. A still further disadvantage arises in that the dust sensor can be used in some countries but cannot be used in other countries because commercial power voltages in different countries are different from one another.

When the latter voltage is employed as the operating voltage, arrangement of the vacuum cleaner can be simplified, expense of the vacuum cleaner can be surpressed, and causes a claim for the imperfect contact are prevented from increasing, because the bellows hose is not to be provided with power supplying wires in an entrained condition. But a disadvantage arises in that the dust sensor circuitry suddenly stops its operation one day, because the dry battery has a discharging life time and the dry battery discharges gradually.

SUMMARY OF THE INVENTION

It is an object of the present invention to automatically determine dust detection sensitivity to be a proper sensitivity without special effort for determining the dust detection sensitivity by an operator.

It is another object of the present invention to generate an operation voltage for a dust sensor and the peripheral circuitry thereof, depending upon to suction force of a vacuum cleaner.

A vacuum cleaner which can vary its suction force and which has a dust sensor for detecting the quantity of dust sucked according to the present invention comprises;

an electrical energy generating means for generating a voltage, corresponding to the suction force, in response to the suction force of the vacuum cleaner, an amplifying means for amplifying an output signal from the dust sensor, and a gain controlling means for varying the dust detection sensitivity of the dust sensor by varying the gain of the amplifying means corresponding to the generated voltage generated by the electrical energy generating means.

When the vacuum cleaner having the arrangement mentioned above is employed, the vacuum cleaner is operated to generate the suction force, the suction force drives the electrical energy generating means so as to generate a voltage corresponding to the suction force. That is, when the suction force is strong, the generated voltage is high, for example. Then, the gain controlling means varies the gain of the amplifying means based upon the generated voltage, thereby automatic determination of the dust detection sensitivity of the dust sensor to a proper sensitivity is carried out. For example, the generated voltage is determined to be high when the suction force is strong. It is sufficient that the gain of the amplifying means is decreased following the increase of the generated voltage so as to determine the dust detection sensitivity to the proper sensitivity. That is, the gain of the amplifying means corresponds to the suction force indirectly by corresponding the gain to the generated voltage. Thereby, determining of the proper dust detection sensitivity corresponding to the suction force is automatically carried out.

More specifically, when cleaning using the vacuum cleaner is carried out and supposing the object of cleaning varies as a wooden floor, tatami mat and carpet in this order, the suction force of the vacuum cleaner has to become stronger in this order. Therefore, when the object of cleaning varies in this order, a proper dust detection sensitivity corresponding to the suction force can be obtained by automatically lowering the dust detection sensitivity of the dust sensor. As a result, no special operation for varying the gain of the amplifying means is needed, even when the object of cleaning varies, and the proper dust detection sensitivity for the object is automatically obtained. That is, the disadvantage that a dust quantity detection signal representing that cleaning is finished, is output when dust remains is overcome. The disadvantage that a dust quantity detection signal representing that cleaning is not finished, is output when no dust remains is overcome.

It is preferrable that the electric energy generating means supplies operating voltage to the dust sensor, amplifying means and the gain controlling means.

When this arrangement is employed, no special power supplying wires are needed, the vacuum cleaner can be simplified in its arrangement, in its entirety. The power supplying wires are used to supply operating voltage to the dust sensor and the peripheral circuitry thereof from the vacuum cleaner body. Also, claims for imperfect contact caused by the special power supplying wires can be prevented from occuring. Further, the dust sensor and peripheral circuitry thereof can be operated irrespective of the commercial a.c. power voltage.

The electric energy generating means may include a rotating device which rotates by a speed corresponding to the suction force of the vacuum cleaner and an electric energy generator which is driven by its rotor, by the rotating force of the rotating device. The electric energy generating means may also include a permanent magnet, coil and vibrating device which is vibrated by the suction force of the vacuum cleaner. The permanent magnet or coil is provided to the vibrating device.

It is preferable that the dust sensor includes a first light emitting device and a first light receiving device, and the amplifying means amplifies the variation in current of the first light receiving device.

It is also preferable that the gain controlling means includes plural operational amplifiers, each of which is supplied with a different input reference voltage, second light emitting devices, each of which is driven by the output signal of one of the operational amplifier, and second light receiving devices, each of which corresponds to one of the second light emitting devices and is connected in parallel to the first light receiving device.

The above, and other objects, features and advantages of this invention will be apparent from the following detailed description of illustrative embodiments which are to be read with the accompanying drawings.

DETAILED DESCRIPTION OF THE PREFERRED EMBODIMENTS

Figure 1:
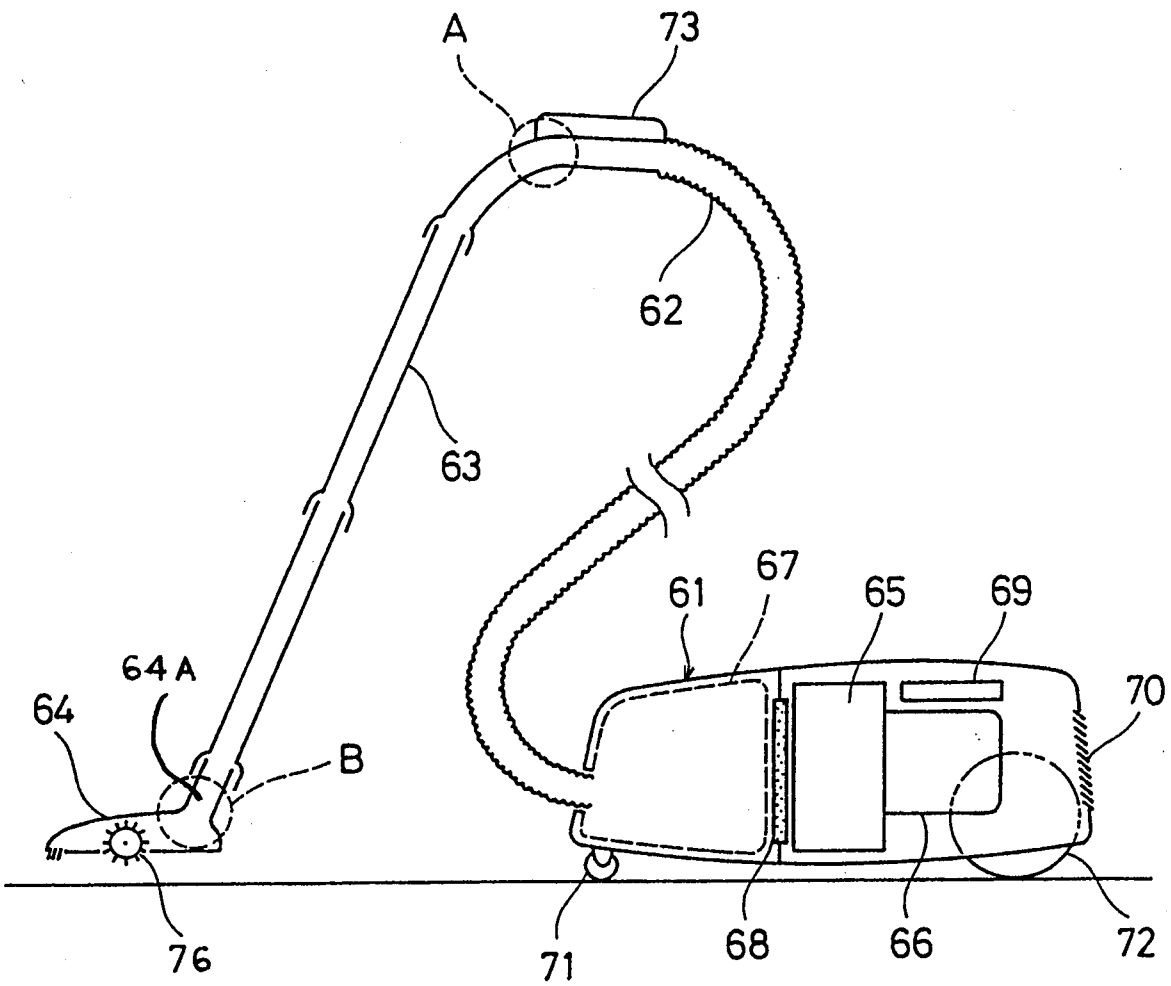
FIG. 1 is a vertical cross sectional view schematically illustrating a vacuum cleaner according to an embodiment of the present invention.

FIG. 1 is a vertical cross sectional view schematically illustrating a vacuum cleaner according to an embodiment of the present invention.

The vacuum cleaner includes a vacuum cleaner body 61, a bellows hose 62, an extending hose 63 which is secured to the leading edge portion of the bellows hose 62 in a pull and remove manner, and a floor nozzle section 64 which is provided to the leading edge portion of the extending hose 63. The vacuum cleaner body 61 includes a suction fan 65, a motor 66 for driving the suction fan 65, a dust bag 67 for collecting sucked dust, a filter 68 for collecting fine dust which is not collected by the dust bag 67, a motor controlling section 69 for controlling the motor 66 so as to vary the suction force caused by the suction fan 65, an exhaust hole 70, a carter 71 and wheels 72. The bellows hose 62 has an operating section 73 at its leading edgeward predetermined position. The operating section 73 controls varying of the suction force.

Figure 2:
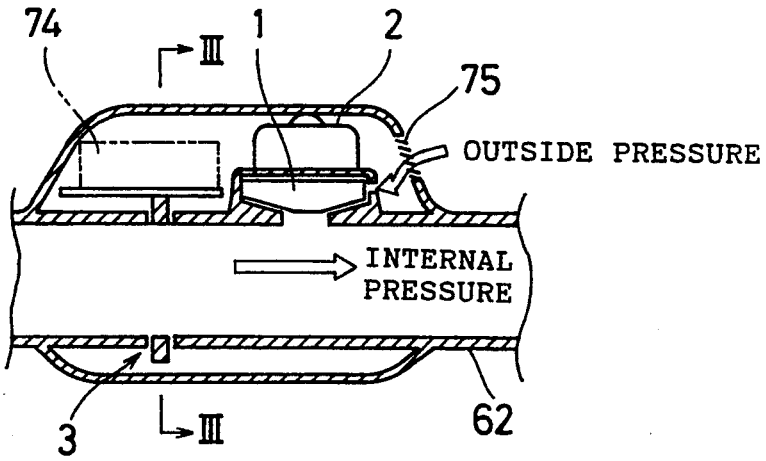
FIG. 2 is a vertical cross sectional view of an enlarged portion of the vacuum cleaner surrounded by circle A in FIG. 1.
Figure 3:
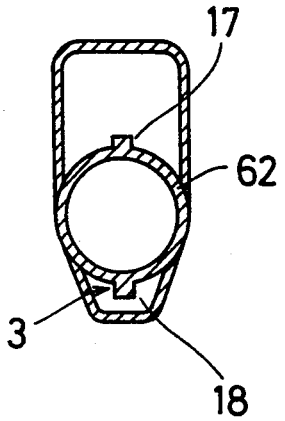
FIG. 3 is a cross section view taken along a line III—III in FIG. 2.

As is illustrated in FIGS. 2 and 3 in detail, a neighbouring portion of an operating section 73 (refer to circle A in FIG. 1) includes a dust sensor 3, a dust sensor circuitry section 74, a rotary turbine wheel 1, and a d.c. electric energy generator 2 which is driven by the rotary turbine wheel 1. The dust sensor 3 detects the quantity of dust which is sucked so as to be collected by the dust bag 67 and the filter 68. The dust sensor circuitry section 74 performs processing based upon an output signal from the dust sensor 3. An air inlet hole 75 which provides communication between the interior and exterior of the neighbouring portion, is formed at a predetermined position neighbouring the rotary turbine wheel 1. The bellows hose 62 includes wires (not shown) for electrically connecting the operating section 73 and the motor controlling section 69. The extending hose 63 can be extended or shortened to match the height and the like of an operator. The floor nozzle section 64 has an object area for sucking dust, which area is different from an opening shape of the extending hose 63. The floor nozzle section 64 includes a rotary brush 76 so as to easily suck dust which lie or stick to an object region for cleaning. The rotary brush 76 is arranged to be varied in rotating speed in response to a command generated by the operating section 73 for varying the suction force of the vacuum cleaner. The dust sensor 3 includes a light emitting device 17 and a light receiving device 18 which are disposed with respect to the bellows hose 62 at predetermined position and are opposed to one another. The light emitting device 17 and the light receiving device 18 pierces the corresponding wall of the bellows hose 62. The dust sensor 3 further includes transparent plates, transparent films and the like (not shown) for covering a light emitting face of the light emitting device 17 and a light receiving face of the light receiving device 18.

In this embodiment, electric devices necessary for the rotary turbine wheel 1, the d.c. electric energy generator 2 and the dust sensor 3, and electric devices necessary for the operating section 73 can be collected in one portion, because the rotary turbine wheel 1, the d.c. electric energy generator 2 and the dust sensor 3 are provided to the leading edge portion of the bellows hose 62. The rotary turbine wheel 1, the d.c. electric energy generator 2, the dust sensor 3 and a display section (not shown) may be provided to a neighbouring portion of a base section of the floor nozzle section 64 (refer to circle B in FIG. 1). When this arrangement is employed, it is easily Judged through the display section whether or not cleaning is finished, because an operator carries out cleaning looking at the floor nozzle section 64. When the latter arrangement is employed, the necessary components can be housed in a standing neck portion 64*a* of the floor nozzle section 64. The necessary components also can be housed in an assistant hose (not shown) which is interposed between the floor nozzle section 64 and the extending hose 63.

Figure 4:
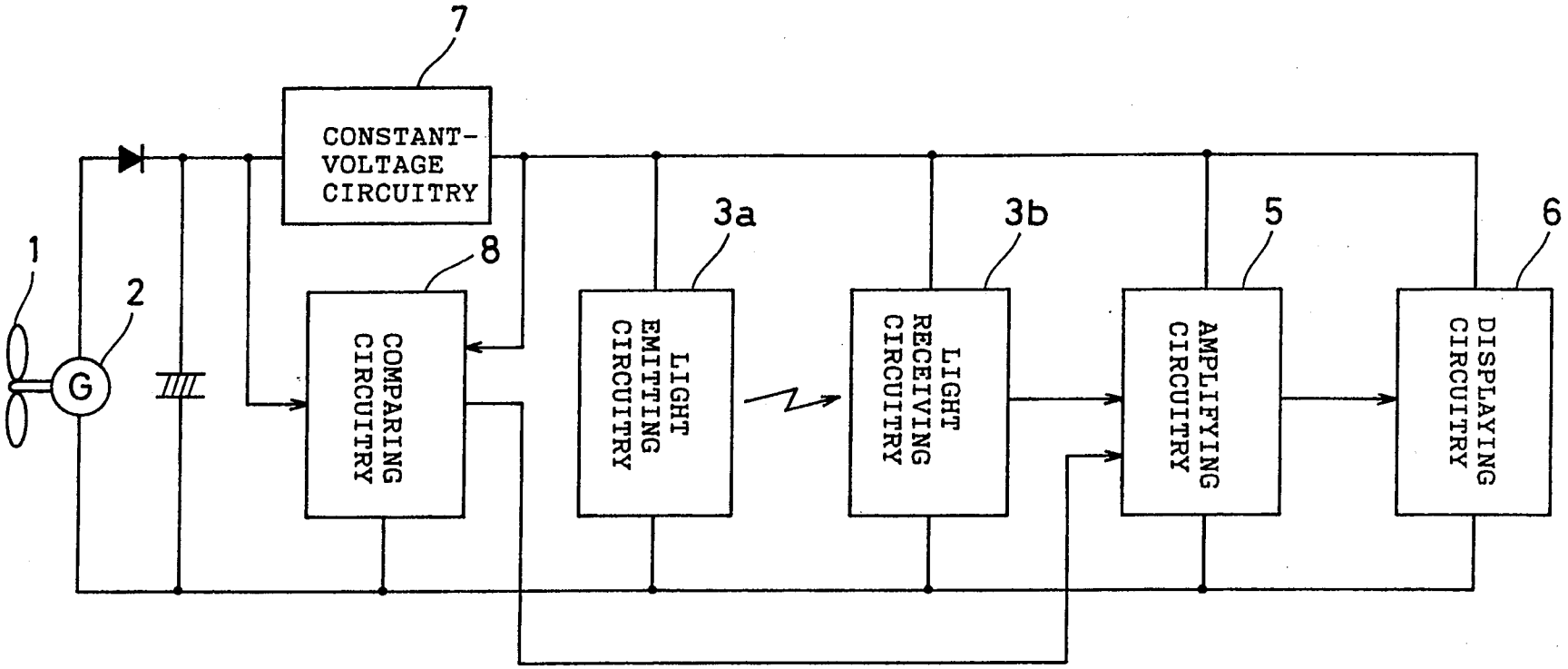
FIG. 4 is a block diagram schematically illustrating a main portion of the vacuum cleaner.

FIG. 4 is a block diagram schematically illustrating a main portion (a portion for automatically adjusting dust detection sensitivity for the dust sensor 3) of the vacuum cleaner illustrated in FIGS. 1–3.

The main portion includes the rotary turbine wheel 1, the d.c. electric energy generator 2, light emitting circuitry 3*a* and light receiving circuitry 3*b* both constructing the dust sensor 3, amplifying circuitry 5 for the dust sensor for amplifying an output signal from the dust sensor 3, displaying circuitry 6, constant-voltage circuitry 7, and comparing circuitry 8 constructing a part of gain controlling circuitry. The rotary turbine wheel 1 is rotated by suction force (more accurately, difference pressure between internal pressure of the bellows hose 62 and outside pressure thereof) which is generated by operating the suction fan 65. The d.c. electric energy generator 2 is driven by its rotary shaft by the rotary turbine wheel 1 so as to generate d.c. voltage corresponding to a rotating speed of the rotary turbine wheel 1. The displaying circuitry 6 visibly displays the condition of whether or not cleaning is finished based upon an output signal from the amplifying circuitry 5. The displaying circuitry 6 also visibly displays the quantity of collected dust based upon an output signal from a sensor (not shown) which detects collected dust. The comparing circuitry 8 receives and compares a constant voltage output from the constant-voltage circuitry 7 and the d.c. voltage generated by the d.c. electric energy generator 2, and outputs a gain controlling signal corresponding to a difference voltage between the constant voltage and the d.c. voltage. The gain controlling signal is supplied to an input terminal for gain controlling of the amplifying circuitry 5 for the dust sensor. The difference voltage corresponds to the d.c. voltage generated by the d.c. electric energy generator 2, because the voltage output from the constant-voltage circuitry 7 is kept at its level constant.

In the main portion illustrated in FIG. 4, it is supposed that the output voltage from the constant-voltage circuitry 7 is determined to be about 3 volts, that the d.c. voltage generated by the d.c. electric energy generator 2 is determined to be about 5 volts when the suction force is small, that is the vacuum cleaner is weakly driven, and that the d.c. voltage generated by the d.c. electric energy generator 2 is determined to be about 20 volts when the suction force is great, that is the vacuum cleaner is strongly driven. Under the assumption, the gain of the amplifying circuitry 5 for the dust sensor is determined to be its maximum value based upon the output signal from the comparing circuitry 8 when the d.c. voltage generated by the d.c. electric energy generator 2 is about 5 volts. The gain of the amplifying circuitry 5 for the dust sensor is gradually lowered following the increase of the d.c. voltage generated by the d.c. electric energy generator 2. The gain of the amplifying circuitry 5 for the dust sensor is determined to be its minimum value based upon the output signal from the comparing circuitry 8 when the d.c. voltage generated by the d.c. electric energy generator 2 is about 20 volts.

In a case that cleaning is carried out by operating the suction fan 65, light radiated from the light emitting circuitry 3*a* is blocked by sucked dust so as to decrease incident light to the light receiving circuitry 3*b*, when cleaning is not finished. The extent of blocked radiated light is nearly in proportion to quantity of sucked dust. An output signal from the light receiving circuitry 3*b* is accordingly at a low level, and an output signal from the amplifying circuitry 5 for the dust sensor is also at a low level (the output signal from the amplifying circuitry 5 has a higher level than of the output signal from the light receiving circuitry 3*b*), so that the displaying circuitry 6 displays a condition in which cleaning is not finished. Therefore, an operator continues cleaning using the vacuum cleaner. On the contrary, when cleaning is finished, radiated light from the light emitting circuitry 3*a* is received by the light receiving circuitry 3*b* with a scarcely blocked condition. The output signal from the light receiving circuitry 3*b* is accordingly at a high level, and the output signal from the amplifying circuitry 5 for the dust sensor is also at a high level, so that the displaying circuitry 6 displays a condition in which cleaning is finished. Therefore, the operator stops cleaning using the vacuum cleaner.

A received light level of the light receiving circuitry 3*b* for displaying a condition in which cleaning is finished, is automatically determined based upon the output signal from the comparing circuitry 8, as is described earlier. Therefore, the received light level is determined to be a minimum level when the suction force of the vacuum cleaner is determined to have great force which allows sucking material other than such as pulled wool hairs of carpet fiber and the like. On the contrary, the received light level is determined to be a maximum level when the suction force of the vacuum cleaner is determined to have weak force which scarcely allows sucking material other than dust. As a result, a condition in which cleaning is finished can accurately be detected and displayed based upon the quantity of sucked dust with scarce influence or materials other than dust.

As is apparent from the foregoing, the bellows hose is not to be provided with power supplying wires especially for the dust sensor and peripheral circuitry thereof in an entrained condition so that the vacuum cleaner can be simplified in its arrangement, in its entirety, and can be decreased in its cost, because the d.c. voltage generated by the d.c. electric energy generator 2 is supplied to the constant-voltage circuitry 7 so as to obtain an operating voltage of the dust sensor 3 and peripheral circuitry thereof. The dust sensor 3 and peripheral circuitry can be operated irrespective of commercial a.c. power voltage. Further, imperfect contact caused by power supplying wires can be prevented from occurring because power supplying wires especially for the dust sensor and peripheral circuitry thereof are not needed at all.

Figure 5:
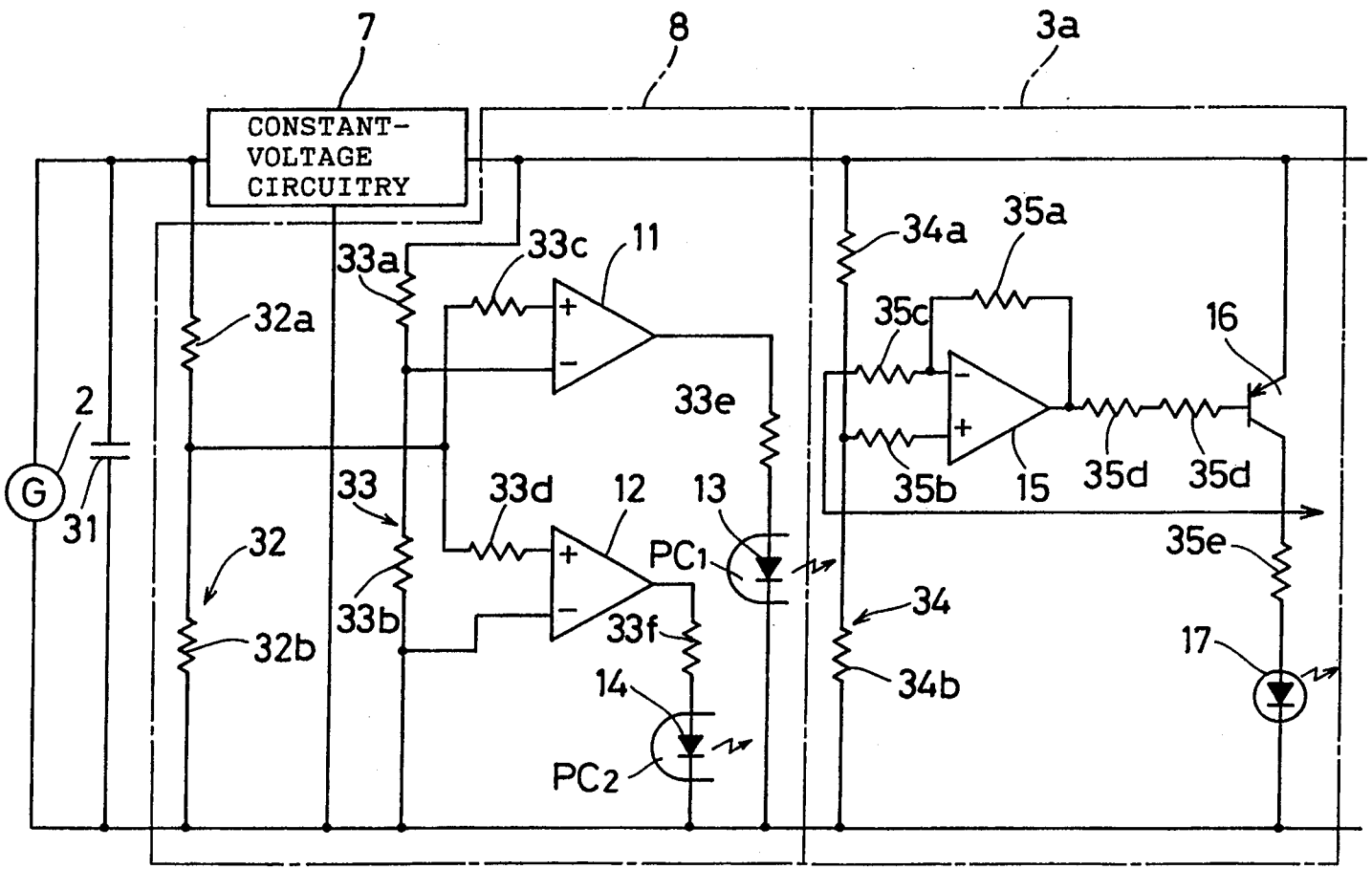
FIG. 5 is an electric circuit diagram illustrating a specific electric circuit arrangement of a portion of the block diagram of FIG. 4.
Figure 6:
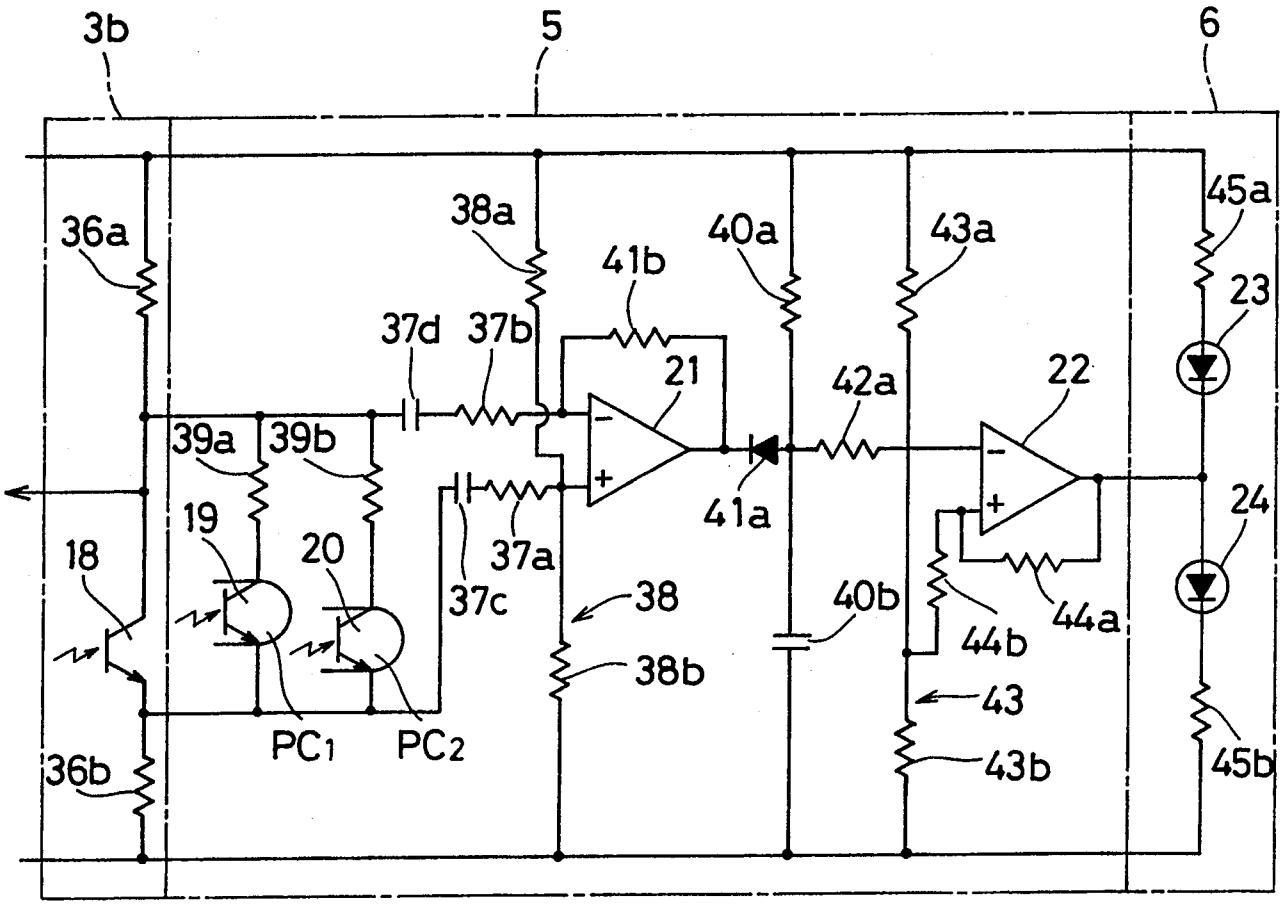
FIG. 6 is an electric circuit diagram illustrating a specific electric circuit arrangement of the remaining portion of the block diagram in FIG. 4.

FIGS. 5 and 6 are electric circuit diagrams illustrating a specific circuit arrangement of the block diagram in FIG. 4. Portions corresponding to each component in FIG. 4 are surrounded by dashed lines and are applied the same reference numeral as in FIG. 4.

A smoothing capacitor 31 is connected between both terminals of the d.c. electric energy generator 2, and a resistance type potential dividing circuit 32 in which a pair of resistors 32*a* and 32*b* are interconnected to one another in series, is connected between both terminals of the d.c. electric energy generator 2. Also, the d.c. voltage generated by the d.c. electric energy generator 2 is supplied to the constant-voltage circuitry 7. A resistance type potential dividing circuit 33 in which a pair of resistors 33*a* and 33*b* are interconnected to one another in series, is connected between the terminals of the constant-voltage circuitry 7.

The comparing circuitry 8 includes two operational amplifiers 11 and 12. Light emitting devices 13 and 14 of photo-couplers PC1 and PC2 are connected to the output terminal of the operational amplifiers 11 and 12 in series, respectively. The photo-couplers PC1 and PC2 constitute a gain controlling circuit. A voltage obtained by the resistance type potential dividing circuit 32 is supplied to a non-reverse input terminal of both operational amplifiers 11 and 12, the obtained voltage being in proportion to the d.c. voltage generated by the d.c. electric energy generator 2. Voltages different from one another, which are obtained by the resistance type potential dividing circuit 33, are supplied to a reverse input terminal of the operational amplifiers 11 and 12, respectively. That is, the voltage proportional to the d.c. voltage generated by the d.c. electric energy generator 2 (the voltage obtained by the resistance type potential dividing circuit 32) are compared with the voltages different from one another, because the voltages different from one another are supplied to the reverse input terminal of the operational amplifiers 11 and 12, respectively. Therefore, a condition in which both light emitting devices 13 and 14 are operated, a condition in which only one light emitting device 14 is operated, and a condition in which neither light emitting device 13 or 14 is operated, are selected in response to the d.c. voltage generated by the d.c. electric energy generator 2. Biasing resistors 33*c* and 33*d* are connected to the non-reverse input terminal of the operational amplifiers 11 and 12, respectively. Also, biasing resistors 33*e* and 33*f* are connected between the output terminal of the operational amplifiers 11 and 12 and the light emitting devices 13 and 14, respectively.

The light emitting circuitry 3*a* which is a part of the dust sensor 3, includes an operational amplifier 15, a transistor 16 and a light emitting device 17 such as a photo-diode or the like. The operational amplifier 15 is supplied a constant voltage to its non-reverse input terminal by a resistance type potential dividing circuit 34 in which a pair of resistors 34*a* and 34*b* are interconnected to one another in series. A reverse input terminal of the operational amplifier 15 is connected to the light receiving circuitry 3*b*. An output terminal of the operational amplifier 15 is connected to a base terminal of the transistor 16. A feedback resistance 35*a* is connected between the output terminal and the reverse input terminal of the operational amplifier 15. Biasing resistors 35*b*, 35*c* and 35*d* are connected to both input terminal and the output terminal in series, respectively. A biasing resistor 35*e* is connected between a collector terminal of the transistor 16 and the light emitting device 17. The light receiving circuitry 3*b* includes a light receiving device 18 such as a photo-transistor and the like, and biasing resistors 36*a* and 36*b* which are connected to a collector terminal and an emitter terminal of the light receiving device 18 in series, respectively.

The amplifying circuitry 5 for the dust sensor includes an operational amplifier 21 which amplifies a light receiving signal detected by the light receiving device 18 of the light receiving circuitry 3*b*, and an operational amplifier 22 which functions as a timer. A reverse input terminal and a non-reverse input terminal of the operational amplifier 21 are connected to the collector terminal and the emitter terminal of the photo-transistor 18, respectively, by interposing resistors 37*a*, 37*b* and capacitors 37*c*, 37*d* connected in series. The non-reverse input terminal of the operational amplifier 21 is supplied with a constant voltage which is obtained by a resistance type potential dividing circuit 38 in which a pair of resistors 38*a* and 38*b* are connected to one another in series. Photo-transistors 19 and 20 of the photo-couplers PC1 and PC2 both comprising the gain controlling circuitry, are connected to the photo-transistor 18 in parallel. Biasing resistors 39*a* and 39*b* are connected to the photo-transistors 19 and 20 in series, respectively. A resistor 40*a* and a capacitor 40*b* are connected to one another in series between the output terminals of the constant-voltage circuitry 7. A diode 41*a* is connected in reverse polarity between a connecting point of the resistor 40*a* and the capacitor 40*b*, and the output terminal of the operational amplifier 21. A voltage between both terminals of the capacitor 40*b* is supplied to a reverse input terminal of the operational amplifier 22 through a biasing resistor 42*a*. A constant voltage obtained by a resistance type potential dividing circuit 38 in which a pair of resistors 38*a* and 38*b* are connected to one another in series, is supplied to a non-reverse input terminal of the operational amplifier 22. An output terminal of the operational amplifier 22 is connected to the displaying circuitry 6. A feedback resistor 41*b* is connected between the reverse input terminal and the output terminal of the operational amplifier 21. A feedback resistor 44*a* is connected between the non-reverse input terminal and the output terminal of the operational amplifier 22. A biasing resistor 44*b* is connected to the non-reverse input terminal of the operational amplifier 22.

The displaying circuitry 6 includes a biasing resistor 45*a*, light emitting devices 23 and 24 such as light emitting diodes and the like, and a biasing resistor 45*b*. The biasing resistor 45*a*, light emitting devices 23 and 24 and the biasing resistor 45*b* are interconnected in series in this order. The constant voltage output from the constant-voltage circuitry 7 is applied to the series circuit. The output terminal of the operational amplifier 22 which functions as a timer, is connected to the connecting point of the light emitting devices 23 and 24.

Operation of the vacuum cleaner having the arrangement above-mentioned, is as follows.

When the vacuum cleaner is operated with strong suction force by operating the operating section, voltages obtained by dividing the constant voltage from the constant-voltage circuitry 7 by the resistance type potential dividing circuit 33 are supplied to the reverse input terminal of the operational amplifiers 11 and 12, respectively, while the d.c. voltage generated by the d.c. electric energy generator 2 is divided by the resistance type potential dividing circuit 32 and is supplied to the non-reverse input terminal of the operational amplifier. The latter voltage is relatively higher than the former voltages. Both output signals from the operational amplifiers 11 and 12 are at a high level, accordingly. When weaker suction force, weaker than the strong suction force, is sequentially selected by operating the operating section, the d.c. voltage generated by the d.c. electric energy generator 2 is lowered, following the decrease in suction force. The output signals of the operational amplifiers 11 and 12 become low in this order following lowering of the d.c. voltage generated by the d.c. electric energy generator 2.

When the output signals of the operational amplifiers 11 and 12 are at a high level, both light emitting devices 13 and 14 of the photo-couplers PC1 and PC2 operate so that both light emitting devices 13 and 14 radiate light therefrom. The light receiving devices 19 and 20 are turned "ON" in response to radiation of light from the light emitting devices 13 and 14. Conduction currents accordingly flow through two circuits which are connected in parallel to the light receiving device 18 of the light receiving circuitry **3*b* so that the dust detection sensitivity of the amplifying circuitry 5** for the dust sensor is lowered to its minimum sensitivity.

When the output signal of the operational amplifier 12 is at a high level, while the output signal of the operation amplifier 11 is at a low level, only the light emitting device 14 of the photo-coupler PC1 operates so that the light emitting device 14 radiates light therefrom. Only the light receiving device 20 is turned "ON" in response to radiation of light from the light emitting device 14. A conduction current accordingly flows through only one of the two circuits which are connected in parallel to the light receiving device 18 of the light receiving circuitry **3*b* so that dust detection sensitivity of the amplifying circuitry 5** for the dust sensor is raised to its higher sensitivity.

When both output signals of the operational amplifier 11 and 12 are at a low level, both light emitting devices 13 and 14 of the photo-couplers PC1 and PC2 do not operate so that both light emitting devices 13 and 14 do not radiate light therefrom. The light receiving devices 19 and 20 are turned "OFF" in response to non-radiation of light from the light emitting devices 13 and 14. The two circuits which are connected in parallel to the light receiving device 18 of the light receiving circuitry **3*b* assume an opened circuit condition so that the dust detection sensitivity of the amplifying circuitry 5** for the dust sensor is raised to its maximum sensitivity.

When the transparent plates or transparent films covering the light emitting face of the light emitting device 17 and the light receiving face of the light receiving device 18 are soiled, the quantity of received light by the light receiving device 18 decreases in response to the soiled degree if the soil remains. But, in this embodiment, when the quantity of received light by the light receiving device 18 decreases, a voltage at an interconnecting point of the light receiving device 18 and the resistor **36*a* is raised, causing a supplied voltage to the reverse input terminal of the operational amplifier 15 to be raised, because the reverse input terminal of the operational amplifier 15 is connected to the interconnecting point of the light receiving device 18 and the resistor 36*a*. When the supplied voltage to the reverse input terminal of the operational amplifier 15 becomes larger than that of the non-reverse input terminal of the operational amplifier 15, the output signal from the operational amplifier 15 becomes in low level so that a base current and a collector current of the transistor 16 are increased. Therefore, a conduction current of the light emitting device 17 is increased causing increasing of the quantity of radiated light from the light emitting device 17**, so that the decrease in the quantity of light caused by soiling of the transparent plates or the transparent films can be compensated.

When the transparent plates or transparent films are not soiled, the quantity of received light by the light receiving device 18 is large so that the supplied voltage to the reverse input terminal of the operational amplifier 15 becomes lower than that of the non-reverse input terminal of the operational amplifier 15. Therefore, the output signal from the operational amplifier 15 becomes a high level so that the base current and the collector current of the transistor 16 are decreased, and the quantity of radiated light from the light emitting device 17 is decreased.

As is apparent from the foregoing, the electical diagram illustrated in FIGS. 5 and 6 classifies the d.c. voltage generated by the d.c. electric energy generator 2 into three classes such as a high voltage, a medium voltage and a low voltage, and automatically changes the dust detection sensitivity to one of three sensitivity classes in response to the d.c. voltage generated by the d.c. electric energy generator 2.

Of course, the present invention is not limited to the specific example above-mentioned. The present invention is applicable to a vacuum cleaner in which dust detection sensitivity is changed to one of more than three classes. The present invention is also applicable to a vacuum cleaner in which dust detection sensitivity is continuously varied in response to the d.c. voltage generated by the d.c. electric energy generator 2.

Operation of the specific example is further described in the following.

The operational amplifier amplifies only current variation of the photo-transistor 18 because the operational amplifier 21 is connected to capacitors **37*c* and 37*d* at both its input terminals, in series, respectively. Therefore, when the current of the photo-transistor 18 is not varied, an input voltage input to the non-reverse input terminal of the operational amplifier 21, that is a voltage divided the constant voltage of the constant-voltage circuitry 7 by the resistance type potential dividing circuit 38, appears at the output terminal of the operational amplifier 21**.

When dust is sucked and blocks the radiated light from the light emitting device 17, a collector-emitter voltage of the photo-transistor 18 is raised so that the output voltage of the operational amplifier 21 is shifted to a negative side by a variation value * amplification degree (amplification degree of the operational amplifier 21). The mark "*" indicates multiplication. The amplification degree of the operational amplifier 21 is about 10,000 times and is sufficiently large, so that the output voltage of the operational amplifier 21 is shifted to the negative side by a value approximate its maximum value. Electric charge in the capacitor **40*b* is applied to the output side of the operational amplifier 21 so as to lower the voltage between both terminals of the capacitor 40*b*. The operational amplifier 22 functions as a timer. When the electric charge in the capacitor 40*b* is applied to the output side of the operational amplifier 21 and an input voltage at the reverse input terminal of the operational amplifier 22 is lower than an input reference voltage at the non-reverse input terminal thereof, a signal level at the output terminal of the operational amplifier 22 varies from a low level to a high level. On the contrary, when the capacitor 40*b* is charged through the resistor 40*a* and the voltage between both terminals of the capacitor 40*b* is equal or greater than the input reference voltage at the non-reverse input terminal of the operational amplifier 22, the signal level at the output terminal of the operational amplifier 22 varies from a high level to a low level. When the signal level at the output terminal of the operational amplifier 22 is a low level, current flows through the light emitting device 23 so as to radiate light from the light emitting device 23. The radiation of light from the light emitting device 23 displays a condition in which cleaning is finished. On the contrary, when the signal level at the output terminal of the operational amplifier 22 is a high level, current flows through the light emitting device 24 so as to radiate light from the light emitting device 24. The radiation of light from the light emitting device 24** displays a condition in which cleaning is not finished.

In the embodiment above-mentioned, a propeller fan may be employed as substitute for the rotary turbine wheel 1. A mechanism for transferring rotating force of the turbine type rotary brush 76 to the d.c. electric energy generator may be employed, and fan, turbine and the like especially for driving the d.c. electric energy generator 2 may be canceled. An a.c. electric energy generator may be employed as substitute for the d.c. electric energy generator 2. When the a.c. electric energy generator is employed, an a.c. voltage generated by the a.c. electric energy generator is rectified and smoothed.

Second Embodiment

Figure 7:
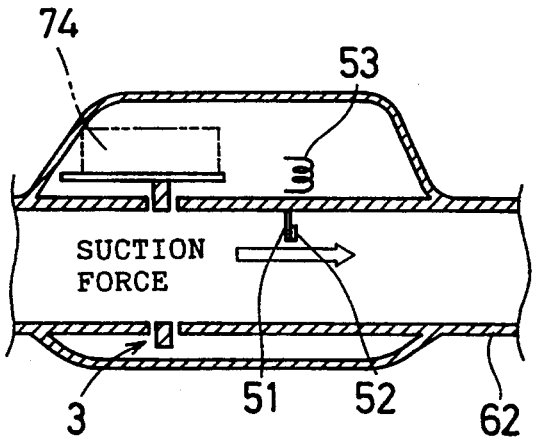
FIG. 7 is a vertical cross sectional view schematically illustrating a main portion of a vacuum cleaner according to another embodiment of the present invention.

FIG. 7 is a vertical cross sectional view schematically illustrating a main portion of a vacuum cleaner according to another embodiment of the present invention.

The vacuum cleaner differs from the vacuum cleaner illustrated in FIG. 1 in the following points.

(1) A vibrating piece 51 provided at a predetermined position in the sucking air passage, a small sized permanent magnet 52 provided to the vibrating piece 51, and a coil 53 provided to the operating section of the bellows hose 62 in a stable manner are employed instead of the rotary turbine wheel 1 and the d.c. electric energy generator 2, and (2) a diode (not shown) for rectifying an output voltage from the coil 53 and for supplying the rectified voltage to the smoothing capacitor 31 (refer to FIG. 5) is employed.

The vibrating piece 51 is a vibrating piece which is vibrated by air flowing such as a reed piece of a harmonica, one of a species of musical instruments, for example. The small sized permanent magnet 52 has sufficiently strong magnetic force. The coil 53 is disposed to intersect a varying magnetic field caused by vibration of the small sized permanent magnet 52.

When this embodiment is employed, the vibrating piece 51 vibrates with higher frequency when the suction force of the vacuum cleaner is determined to be strong, while the vibrating piece 51 vibrates with lower frequency when the suction force of the vacuum cleaner is determined to be weak. When the vibration frequency is high, density variation of interlinkage flux to the coil 53 is large, while density variation of interlinkage flux to the coil 53 is small, when vibration frequency is low. The larger the density variation is, the higher the induced electromotive force of the coil 53 is. That is, the induced electomotive force is high when the suction force is strong, while the induced electromotive force is low when the suction force is weak. The induced electromotive force appears as an a.c. voltage and the a.c. voltage is rectified by the diode (not shown) and then is smoothed by the smoothing capacitor 31. Thereafter, similar operation as of the embodiment above-mentioned is carried out so that the gain of the amplification circuitry 5 for the dust sensor is controlled corresponding to the suction force, and that a condition, whether or not cleaning is finished, is accurately displayed.

In this embodiment, the coil 53 may be provided to the vibrating piece 51 and the permanent magnet may be provided in a stable manner. In this case, a similar operation as of this embodiment can be performed.

Various modifications and variations will occur to those skilled in the art without departing from the spirit and scope of the invention as defined by the appended claims.

What is claimed is:

1. A vacuum cleaner capable of producing a variable suction force, comprising:

a dust sensor for detecting a quantity of dust being sucked by said vacuum cleaner and producing an output signal representative of a quantity of dust detected;

electrical energy generating means for generating a voltage representative of a suction force produced by said vacuum cleaner;

amplifying means for amplifying said output signal by a gain;

gain controlling means for varying said gain by which said amplifying means amplifies said output signal in response to a change in voltage generated by said electrical energy generating means.

2. A vacuum cleaner as set forth in claim 1, wherein said electrical energy generating means supplies an operating voltage to said dust sensor, said amplifying means, or said gain controlling means.

3. A vacuum cleaner as set forth in claim 1, wherein said electric energy generating means includes a rotating device which rotates at a speed corresponding to a suction force produced by said vacuum cleaner and an electric energy generator which includes a rotor which is driven by rotation of said rotating device.

4. A vacuum cleaner as set forth in claim 1, wherein said electric energy generating means includes a permanent magnet and a coil which are inductively coupled together, and a vibrating device which is vibrated by a suction force produced by said vacuum cleaner, one of said permanent magnet and said coil being provided to said vibrating device.

5. A vacuum cleaner as set forth in claim 1, wherein said dust sensor includes a first light emitting device and a first light receiving device, said output signal being produced by variations in current generated by said first light receiving device.

6. A vacuum cleaner as set forth in claim 5, wherein said gain controlling means includes plural operational amplifiers, each of which is supplied with a different input reference voltage, plural second light emitting devices, each of which is driven by an output signal from one of said operational amplifiers, and plural second light receiving devices, each of which corresponds to one of said light emitting devices and is connected in parallel to said first light receiving device.

* * * * *